US006951368B2

(12) United States Patent
Self

(10) Patent No.: US 6,951,368 B2
(45) Date of Patent: Oct. 4, 2005

(54) CHAIR COVERS

(76) Inventor: Melba Delaine Self, 15352 Inlet Pl., Dumfries, VA (US) 22026

( * ) Notice: Subject to any disclaimer, the term of this patent is extended or adjusted under 35 U.S.C. 154(b) by 0 days.

(21) Appl. No.: 09/939,646

(22) Filed: Aug. 28, 2001

(65) Prior Publication Data

US 2002/0063455 A1 May 30, 2002

Related U.S. Application Data

(63) Continuation-in-part of application No. 29/117,347, filed on Jan. 24, 2000.

(51) Int. Cl.[7] ..... A47C 31/00
(52) U.S. Cl. ..... 297/229; 297/219.1; 297/228.1
(58) Field of Search ..... 297/229, 219.1, 297/228, 256.1, 397, 188.06, 219.12

(56) References Cited

U.S. PATENT DOCUMENTS

| | | | | | |
|---|---|---|---|---|---|
| 3,504,941 | A | * | 4/1970 | Gerard | 297/219.1 |
| 4,273,380 | A | | 6/1981 | Silvestri | |
| 4,553,785 | A | | 11/1985 | Duke, Jr. et al. | |
| 4,597,605 | A | * | 7/1986 | Gilbert | 297/228.1 X |
| D286,486 | S | | 11/1986 | Goble, Jr. et al. | |
| 4,676,376 | A | * | 6/1987 | Keiswetter | 297/219.1 X |
| 4,725,094 | A | * | 2/1988 | Greer | 297/188.06 |
| 4,773,708 | A | | 9/1988 | Nastu | |
| 4,844,540 | A | | 7/1989 | Pegram | |
| 4,877,288 | A | | 10/1989 | Lee | |
| 4,892,353 | A | | 1/1990 | Goddard | |
| 5,163,192 | A | | 11/1992 | Watson | |
| D341,513 | S | | 11/1993 | Reeves et al. | |
| 5,275,463 | A | * | 1/1994 | Rocha | 297/188.01 |
| 5,326,152 | A | * | 7/1994 | Baron | 206/430 |
| D359,411 | S | | 6/1995 | Wade | |
| D374,789 | S | | 10/1996 | Kalista et al. | |
| 5,624,157 | A | * | 4/1997 | Kostuk | 297/218.1 |
| 5,629,071 | A | | 5/1997 | Feldman | |
| 5,644,807 | A | | 7/1997 | Battistella | |
| D382,756 | S | | 8/1997 | Ryan | |
| D387,939 | S | | 12/1997 | Tedesco et al. | |
| D391,109 | S | | 2/1998 | Miller | |
| D392,146 | S | | 3/1998 | Gregg | |
| 5,730,529 | A | | 3/1998 | Fritz et al. | |
| D416,429 | S | | 11/1999 | Kennard | |
| 6,135,635 | A | * | 10/2000 | Miller et al. | 297/229 |
| 6,149,234 | A | | 11/2000 | Daniels | |
| 6,616,225 | B2 | * | 9/2003 | Graff | 297/229 |

* cited by examiner

*Primary Examiner*—Anthony D. Barfield
(74) *Attorney, Agent, or Firm*—Baker Botts L.L.P.

(57) ABSTRACT

A chair cover includes a first cover surface, a second cover surface, and a non-elastic flap. Moreover, the non-elastic flap is attached to the second cover surface, in which the non-elastic flap and the second cover surface form a pocket therebetween. According to another embodiment, a chair cover includes a first cover surface, a second cover surface, and a non-elastic flap. Moreover, the non-elastic flap is attached to the second cover surface, in which the non-elastic flap and the second cover surface form a pocket therebetween. In addition, the first cover surface and the second cover surface are disposed within the pocket.

8 Claims, 2 Drawing Sheets

CHAIR COVERS

The present application claims priority from U.S. Design Patent Application Ser. No. 29/117,347, entitled "Lounge Chair Tanning Towel," the disclosure of which is incorporated herein by reference in its entirety.

BACKGROUND OF THE INVENTION

1. Field of the Invention

The present invention relates generally to the field of chair covers. More specifically, the invention relates to outdoor recreational chair covers.

2. Description of Related Art

Known chairs, for example, outdoor recreational chairs such as lounge chairs, pool chairs, deck chairs, or the like, may include a plastic, vinyl, or wood surface upon which a user of such recreational chairs may sit or lay. Alternatively, such plastic, vinyl, or wood surfaces may be covered by a mattress, a pad, or the like, such that the user instead may sit or lie on the mattress or the pad. Nevertheless, such plastic, vinyl, or wood surfaces, or such mattresses or pads covering such surfaces, may become soiled during use or may become hot after prolonged exposure to the sun, or both.

In order to reduce or prevent contact with the soiled or hot surface, the user may drape a towel, such as a beach towel, bathroom towel, or the like, over the surface. Nevertheless, during use of the chair, at least a portion of the towel may move away from the sitting surface, which may expose at least a portion of the soiled or hot surface. Consequently, in order to reduce or prevent contact with the soiled or hot surface during use, the user continually may have to readjust the towel. Similar problems may occur when using a towel to cover a mattress pad.

Alternatively, some known recreational chairs may include a frame, which may support the surface, and the user may cover the surface with an external cover. For example, some known chair covers may include an elastic band or strap disposed around at least a portion of an outer edge of the cover, such that the cover may contact the frame, and the elastic band may cinch up the cover, which may allow the cover the conform to the shape of the chair. Moreover, the elastic band may reduce or prevent movement of the chair cover during use, such that the soiled or hot surface may not be exposed. Nevertheless, after prolonged use of such a cover, the cover may become soiled, and the user may wish to wash the cover. However, when such elastic bands are washed, the elastic band may shrink, become deformed, lose elasticity, or the like. Moreover, the elastic band may increase the difficulty of uniformly folding the chair cover after use because the corners of the chair cover may be rounded and the elastic band may pull the edges of the chair cover inward, such that the chair cover may have a non-uniform shape.

SUMMARY OF THE INVENTION

Therefore, a need has arisen for chair covers that overcome these and other shortcomings of the related art. A technical advantage of the present invention is that contact by the user with a soiled or hot chair surface may be reduced or prevented. Another technical advantage of the present invention is that exposure of the user to the soiled or hot surface during use may be reduced or prevented. Yet another technical advantage of the present invention is that the chair cover may be washed without substantially reducing the effectiveness of the chair cover. Still another technical advantage of the present invention is that the chair cover may be substantially uniformly folded after use.

According to an embodiment of the present invention, a chair cover is described. The chair cover comprises a first cover surface, a second cover surface, and a non-elastic flap, i.e., a flap which does not comprise an elastic band. Moreover, the non-elastic flap is attached to the second cover surface, in which the non-elastic flap and the second cover surface form a pocket therebetween.

According to another embodiment of the present invention, a chair cover comprises a first cover surface, a second cover surface, and a non-elastic flap. Moreover, the non-elastic flap is attached to the second cover surface, in which the non-elastic flap and the second cover surface form a pocket therebetween. In addition, at least a portion of the first cover surface and at least a portion of the second cover surface are disposed within the pocket.

According to yet another embodiment of the present invention, a chair cover apparatus comprises chair cover, which comprises a first cover surface, a second cover surface, and a non-elastic flap. The non-elastic flap is attached to the second cover surface, in which the non-elastic flap and the second cover surface form a pocket therebetween. The chair cover also comprises at least one side pocket, which is attached to the first cover surface or the second cover surface. The chair cover apparatus further comprises a chair, which is adapted to receive the chair cover. Moreover, the chair has an upper end and a lower end, the pocket is disposed over at least a portion of the upper end of the chair, the second cover surface may directly contact the chair, and the chair is positioned between the non-elastic flap and the second cover surface.

Other objects, features, and advantages will be apparent to persons of ordinary skill in the art in view of the following detailed description of the invention and the accompanying drawings.

BRIEF DESCRIPTION OF THE DRAWINGS

For a more complete understanding of the present invention, needs satisfied thereby, and objects, features, and advantages thereof, reference now is made to the following descriptions taken in connection with the accompanying drawings.

DETAILED DESCRIPTION OF PREFERRED EMBODIMENTS

Preferred embodiments of the present invention and their advantages may be understood by referring to FIGS. 1–5, like numerals being used for like corresponding parts in the various drawings.

Figure 1:
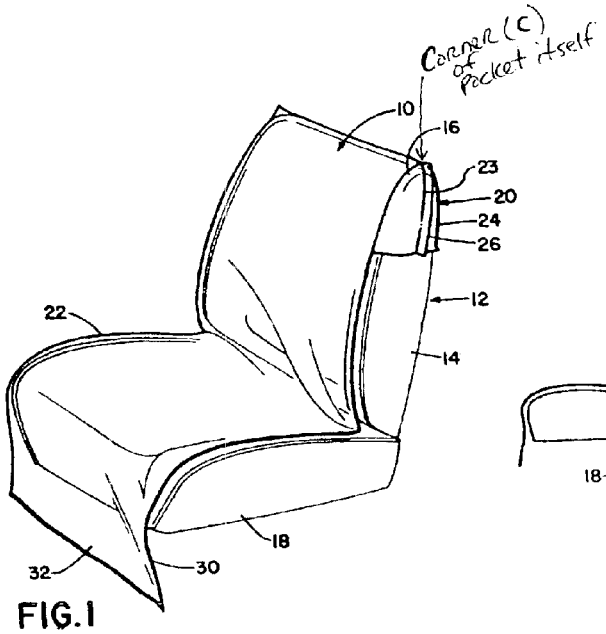
FIG. 1 is a top view of a chair cover according to an embodiment of the present invention.
Figure 2:
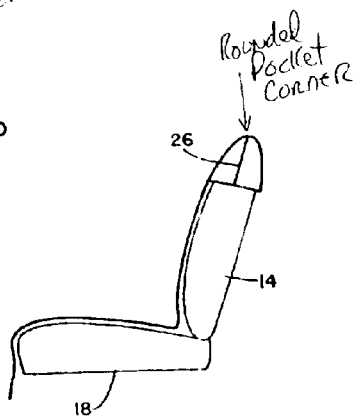
FIG. 2 is a bottom view of a chair cover according to an embodiment of the present invention.

Referring to FIGS. 1 and 2, a chair cover 100 according to an embodiment of the present invention is described. Chair cover 100, may be fabricated from a towel material and may comprise a first cover surface 114 and a second cover surface 116. A towel may be manufactured from absorbent cloth or paper, or any material produced by weaving, knitting, or matting natural or synthetic fibers. Thus, chair cover 100 may be fabricated from any absorbent material produced by weaving, knitting, or matting natural or synthetic fibers. In an embodiment, first cover surface 114 may be a top surface of chair cover 100 and second cover surface 116 may be a bottom surface of chair cover 100. Chair cover 100 further may comprise at least one first side pocket 112*a*, which may be attached to at least a portion of a first edge 118*a* of first cover surface 114, or alternatively, may be attached to at least a portion of a first edge 120*a* of second cover surface 116. Chair cover 100 also may comprise at least one second side pocket 112*b*, which may be attached to at least a portion of a second edge 118*b* of first cover surface 114, or alternatively, may be attached to at least a portion of a second edge 120*b* of second cover surface 116. Moreover, in an embodiment, there may be four first side pockets 112*a*, and there also may be four second side pockets 112*b*. Chair cover 100 further may comprise a first plurality of ties 110*a*, which may be attached to at least a portion of first edge 118*a* of first cover surface 114 or alternatively, may be attached to at least a portion of first edge 120*a* of second cover surface 116. Chair cover 100 also may comprise a second plurality of ties 110*b*, which may be attached to at least a portion of second edge 118*b* of first cover surface 114, or alternatively, may be attached to at least a portion of second edge 120*b* of second cover surface 116. In a preferred embodiment, chair cover 100 may include a pair of first ties 110*a* and a pair of second ties 110*b* positioned on first edge 118*a* and second edge 11*b*, respectively, adjacent to a lower end 122*a*.

In each of the above-described embodiments of the present invention, chair cover 100 also may comprise a non-elastic flap 102, i.e., a flap which does not comprise an elastic band. In addition, at least a portion of non-elastic flap 102 may be attached to at least a portion of second cover surface 116. For example, non-elastic flap 102 may be attached along a portion of first edge 120*a* of second cover surface 116 and along a portion of second edge 120*b* of second cover surface 116. Non-elastic flap 102 also may be attached along an upper edge 120*c* of second cover surface 116. Moreover, the attachment of non-elastic flap 102 and second cover surface 116 may form a packing pocket 104 therebetween, and also may form a plurality of corners 108 along upper edge 120*c* of second cover surface 116. For example, corners 108 may be square corners. In addition, non-elastic flap 102 may have a first flap surface 102*a* and a second flap surface 102*b* (shown in FIG. 4). When chair cover 100 is unfolded, first flap surface 102*b* may be the exterior surface of packing pocket 104 and second flap surface 102*b* may be the interior surface of packing pocket 104.

Figure 3:
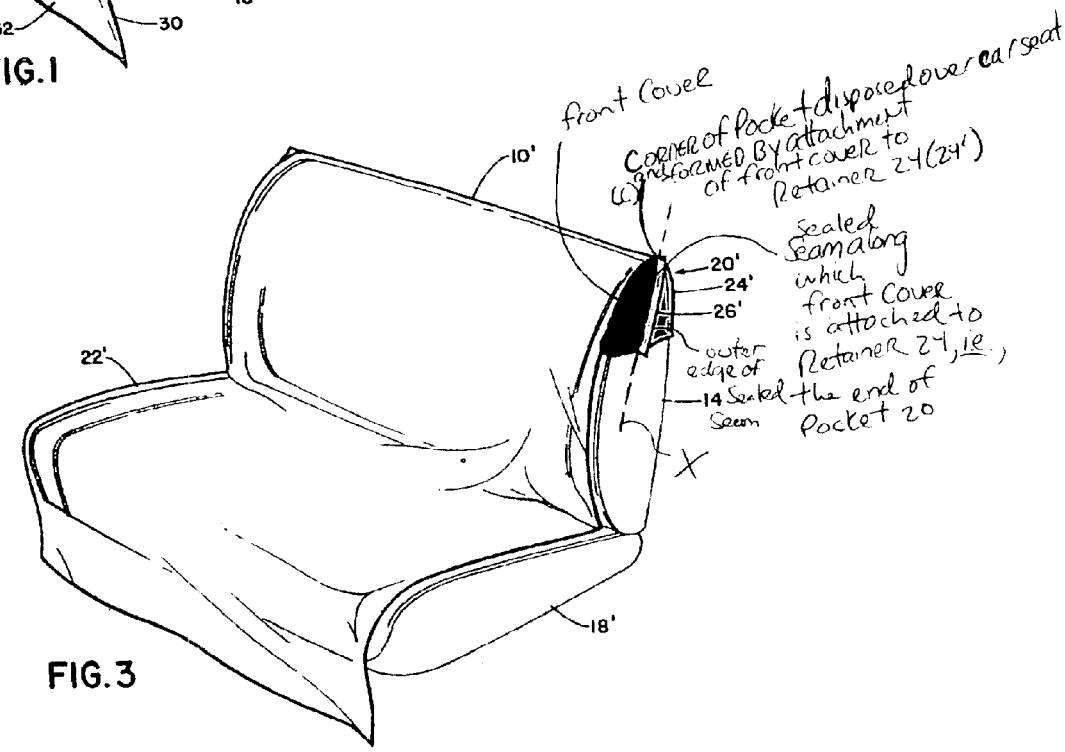
FIG. 3 is a perspective view of a chair cover apparatus according to an embodiment of the present invention.

Referring to FIG. 3, in each of the above-described embodiments of the present invention, chair cover 100 also may comprise a chair 306, which may be adapted to receive chair cover 100. Alternatively, a chair cover apparatus 300 may comprise chair cover 100 and chair 306. For example, packing pocket 104 (not shown in FIG. 3) may be disposed over at least a portion of chair 306, such that chair 306 may be positioned between non-elastic flap 102 and second cover surface 116. In this embodiment, second cover surface 116 and second flap surface 102*b* may directly contact chair 306. Moreover, chair 306 may comprise an upper end 306*a* and a lower end 306*b*, and packing pocket 104 may be disposed over upper end 306*a* of chair 306. In addition, when corners 108 are square corners, corners 108 may retain their substantially square shape when packing pocket 104 is disposed over chair 306.

In this embodiment, when packing pocket 104 is disposed over upper end 306*a* of chair 306, first side pocket 112*a* may hang or drape over a portion of chair 306. For example, first side pocket 112*a* may hang or drape over a substantially middle portion (not numbered) of chair 306, such that a user of chair cover 100 may be able to reach any items stored in first side pocket 112*a* when laying or sitting on chair 306. Similarly, second side pocket 112*b* may hang or drape over a portion of chair 306 opposite first side pocket 112*a*. For example, second side pocket 112*b* may hang or drape over a substantially middle portion (not numbered) of chair 306, such that a user of chair cover 100 may be able to reach any items stored in second side pocket 112*b* when laying or sitting on chair 306. Moreover, in this embodiment, chair 306 further may comprise a lower leg 308, having a first portion and a second portion. The first portion of lower leg 308 may be positioned adjacent to first plurality of ties 110*a*, such that first plurality of ties 110*a* may be tied around the first portion of lower leg 308. Similarly, the second portion of lower leg 308 may be positioned adjacent to second plurality of ties 110*b*, such that second plurality of ties 110*b* may be tied around the second portion of lower leg 308. Tying first plurality of ties 110*a* and second plurality of ties 110*b* around the first portion of lower leg 308 and the second portion of lower leg 308, respectively, substantially may secure lower end 122*a* of chair cover 100 to lower end 306*b* of chair 306.

Figure 4:
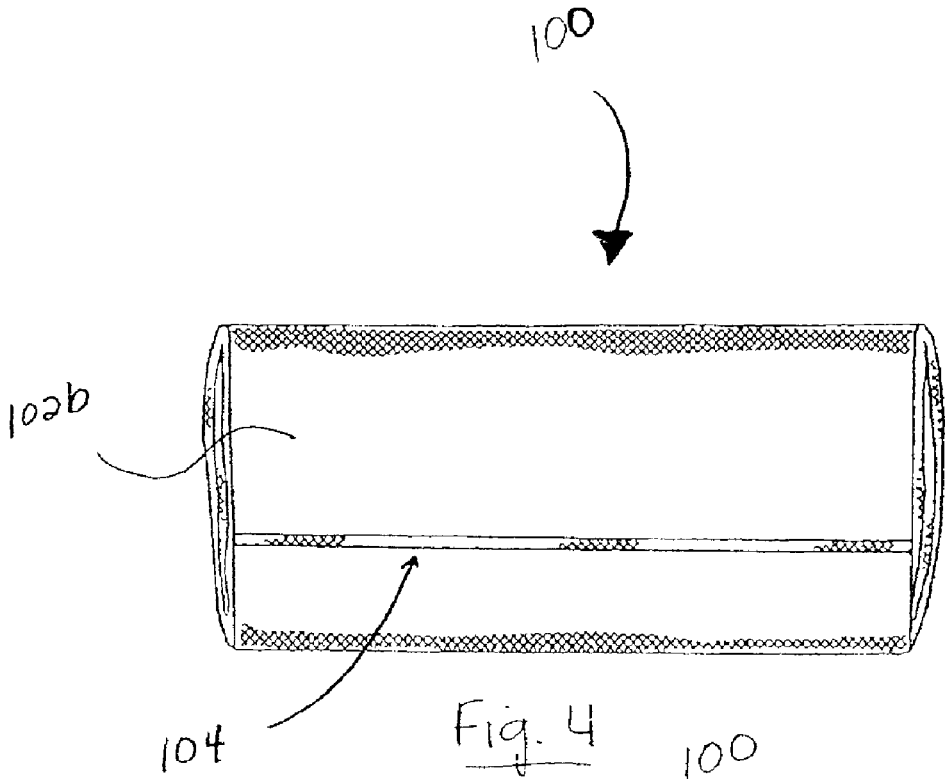
FIG. 4 is a top view of a rolled-up chair cover according to an embodiment of the present invention.
Figure 5:
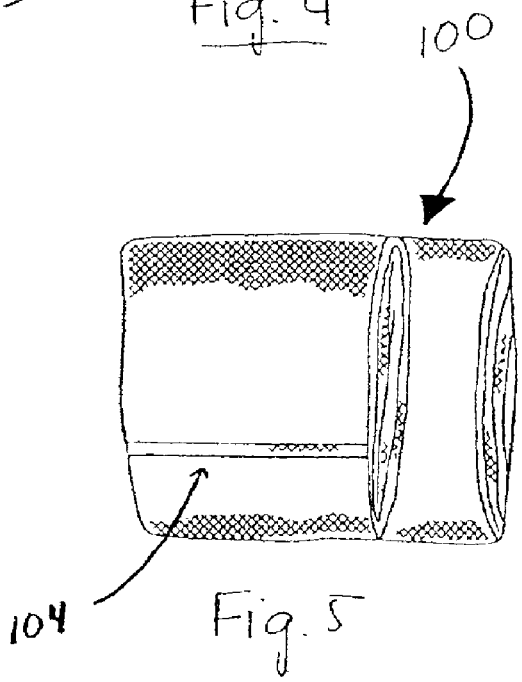
FIG. 5 is a top view of a rolled-up and folded chair cover according to an embodiment of the present invention.
Figure 1:
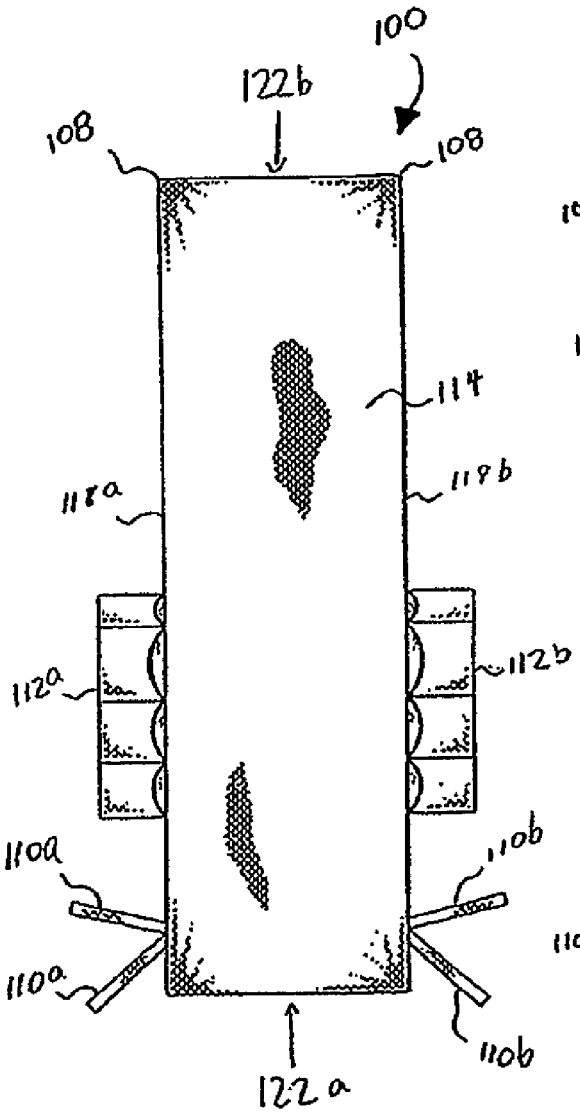
Figure 2:
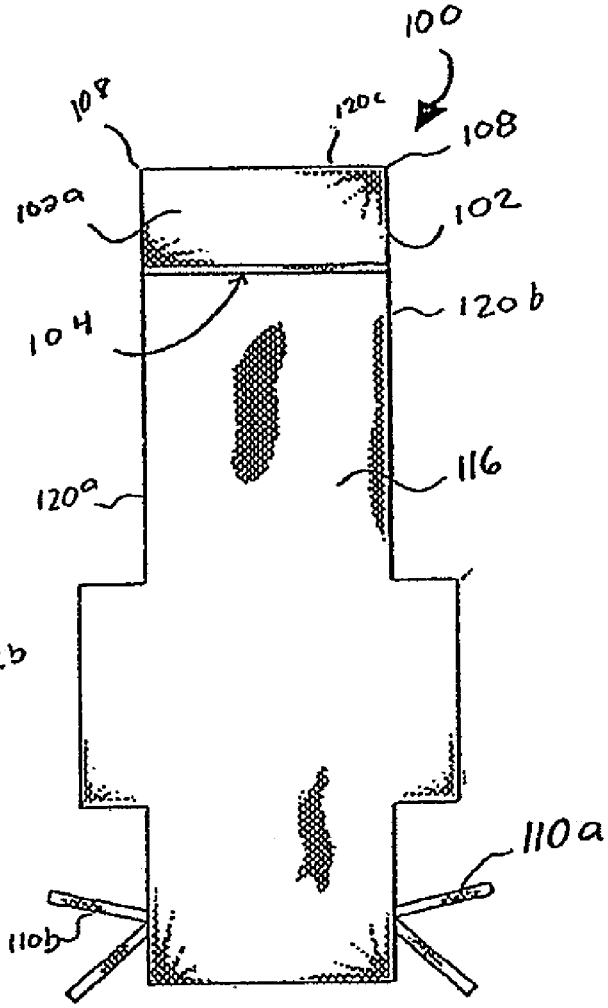
Figure 3:
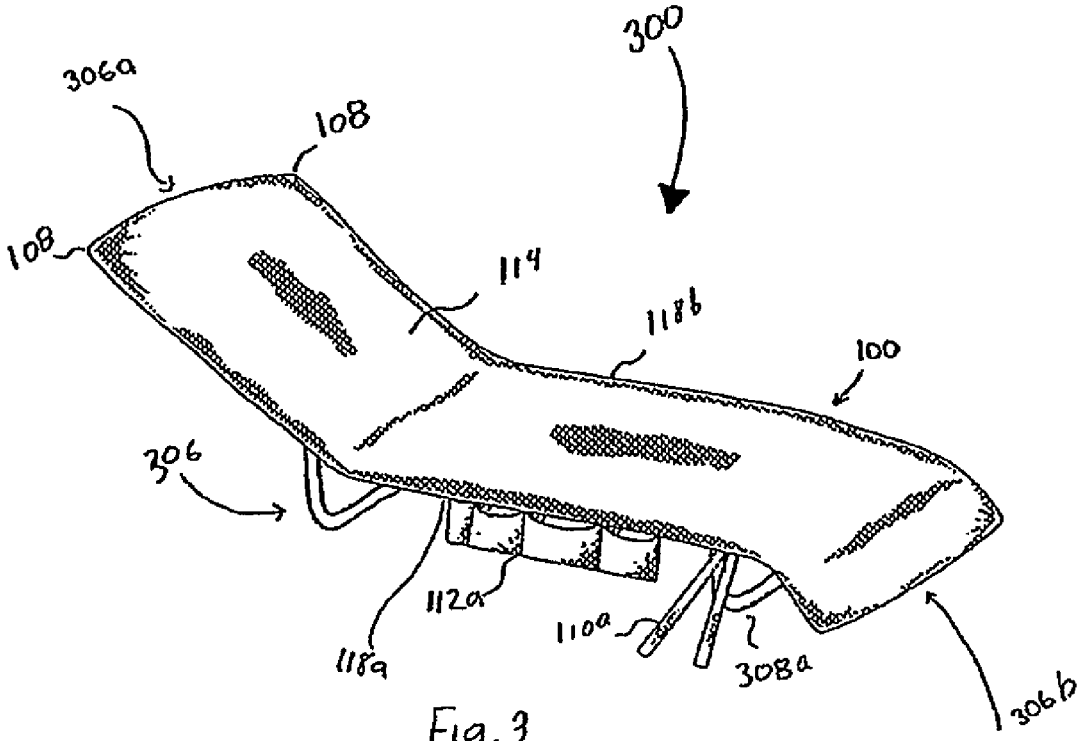

Referring to FIGS. 4 and 5, in each of the above-described embodiments of the present invention, when a chair cover, such as chair cover 100, is not disposed over a chair as shown in FIG. 3, chair cover 100 may be disposed within itself. Specifically, side pockets 112*a* and 112*b* may be folded inward, and a lower end 122*a* of chair cover 100 may be folded or rolled towards an upper end 122*b* of chair cover 100. When lower end 122*a* of chair cover 100 is folded or rolled towards upper end 122*b* of chair cover 100, pockets 112*a* and 112*b* may be captured within folded or rolled chair cover 100. Moreover, as shown in FIG. 4, when lower end 122*a* of chair cover 100 is within substantial proximity of upper end 122*b* of chair cover 100, e.g., when lower end 122*a* of chair cover 100 reaches the opening of packing pocket 104, packing pocket 104 may be turned inside out, such that at least a portion of first cover surface 114 and second cover surface 116 may be substantially disposed within packing pocket 104.

In an embodiment, first cover surface 114, second cover surface 116, and pockets 112*a* and 112*b* may be entirely disposed within packing pocket 104, such that at least a portion of first cover surface 114 and at least a portion of second cover surface 116 may contact first flap surface 102*a*. In addition, because pockets 112*a* and 112*b* may be entirely disposed within packing pocket 104, any items left inside pockets 112*a* and 112*b* also may be disposed within packing pocket 104. As shown in FIG. 5, a size of chair cover 100 further may be reduced by folding chair cover 100 after chair cover 100 has been disposed within itself. Moreover, in each of the above-described embodiments of the present invention, chair cover 100 may be unfolded or unrolled onto chair 306 by disposing packing pocket 104 over chair 306 and pulling on those portions of chair cover 100 disposed within packing pocket 104, such that chair cover 100 may be removed from packing pocket 104 and unfolded onto chair 306.

While the invention has been described in connection with preferred embodiments, it will be understood by those of ordinary skill in the art that other variations and modifications of the preferred embodiments described above may be made without departing from the scope of the invention. Other embodiments will be apparent to those of ordinary skill in the art from a consideration of the specification or practice of the invention disclosed herein. It is intended that the specification and the described examples are considered as exemplary only, with the true scope and spirit of the invention indicated by the following claims.

What I claim is:

1. A chair cover comprising:

a first cover surface;

a second cover surface; and a non-elastic flap attached to said second cover surface, wherein said non-elastic flap and said second cover surface form a pocket therebetween, and said pocket is adapted to be disposed over a chair, and wherein said non-elastic flap has a first edge and a second edge and said second cover surface has a first edge and a second edge and the attachment of said first edge and said second edge of said non-elastic flap directly to said corresponding first and second edges of said second cover surface forms a pair of substantially square corners, and said square corners substantially retain their shape when said pocket is disposed over said chair independent from a shape of said chair, and wherein said pocket is configured to receive a majority of said first cover surface and a majority of said second cover surface.

2. The chair cover of claim 1, wherein said chair cover further comprises a chair adapted to receive said chair cover, wherein said pocket is disposed over at least a portion of said chair and said chair is positioned between said non-elastic flap and said second cover surface.

3. The chair cover of claim 2, wherein said chair comprises an upper end and a lower end, and said pocket is disposed over said upper end of said chair.

4. The chair cover of claim 1, wherein said pocket is configured to receive said at least one side pocket.

5. The chair cover of claim 1, wherein said chair cover further comprises a chair adapted to receive said chair cover and said non-elastic flap has a first flap surface and a second flap surface, wherein when said pocket is disposed over at least a portion of said chair, said first flap surface contacts said chair, and when at least a portion of said first cover surface and at least a portion of said second cover surface are disposed within said pocket, said second flap surface contacts said first cover surface and said second cover surface.

6. The chair cover of claim 1, wherein said first cover surface and said second cover surface are entirely disposed within said pocket.

7. A chair substantially rectangular cover comprising:

a first cover surface;

a second cover surface; and a non-elastic flap attached to said second cover surface, wherein said non-elastic flap and said second cover surface form a pocket therebetween, and said pocket is adapted to be disposed over a chair, wherein said pocket is configured to receive a majority of said first cover surface and a majority of said second cover surface, wherein said non-elastic flap has a first edge and a second edge and said second cover surface has a first edge and a second edge and the attachment of said first edge and said second edge of said non-elastic flap directly to said corresponding first and second edges of said first and second cover surfaces form a pair of substantially square corners, and said square corners substantially retain their shape when said pocket is disposed over said chair independent from a shape of said chair, and wherein said chair cover further comprises at least one side pocket formed outside of said pocket and attached to said first or second edge of said first and second cover surface.

8. A chair cover comprising:

a first cover surface;

a second cover surface; and a non-elastic flap attached to said second cover surface, wherein said non-elastic flap and said second cover surface form a pocket therebetween, and said pocket is adapted to be disposed over a chair, wherein said pocket is configured to receive a majority of said first cover surface and a majority of said second cover surface, wherein said non-elastic flap has a first edge and a second edge and said second cover surface has a first edge and a second edge and the attachment of said first edge and said second edge of said non-elastic flap directly to said corresponding first and second edges of said second cover surface forms a pair of substantially square corners, and said square corners substantially retain their shape when said pocket is disposed over said chair independent from a shape of said chair, and wherein said chair cover further comprises a plurality of means for securing said cover to said chair attached to said first cover surface or said second cover surface.

* * * * *

UNITED STATES PATENT AND TRADEMARK OFFICE

CERTIFICATE OF CORRECTION

PATENT NO. : 6,951,368 B2
APPLICATION NO. : 09/939646
DATED : October 4, 2005
INVENTOR(S) : Melba Delaine Self It is certified that error appears in the above-identified patent and that said Letters Patent is hereby corrected as shown below:

Please delete old drawings and insert these new replacement drawings which are attached.

Signed and Sealed this

Twenty-eighth Day of August, 2007

JON W. DUDAS
*Director of the United States Patent and Trademark Office*